United States Patent [19]

Hovstadius

[11] 4,311,270

[45] Jan. 19, 1982

[54] CENTRIFUGE

[75] Inventor: Oscar G. Hovstadius, Sigtuna, Sweden

[73] Assignee: Alfa-Laval AB, Tumba, Sweden

[21] Appl. No.: 110,626

[22] Filed: Jan. 9, 1980

[30] Foreign Application Priority Data

Jan. 19, 1979 [SE] Sweden ..... 7900523

[51] Int. Cl.[3] ..... B04B 1/10; B04B 11/00

[52] U.S. Cl. ..... 233/46; 209/211

[58] Field of Search ..... 233/46, 47 R, 47 A, 233/20 A, 20 R, 38, 28; 210/369; 209/211, 490

[56] References Cited

U.S. PATENT DOCUMENTS

| | | | |
|---|---|---|---|
| 2,060,239 | 11/1936 | Peltzer | 233/47 R |
| 3,108,952 | 10/1963 | Antz | 233/46 |
| 3,201,036 | 8/1965 | Halbach et al. | 233/46 |
| 4,224,145 | 9/1980 | Skardal | 209/211 |

*Primary Examiner*—Philip R. Coe
*Assistant Examiner*—Timothy F. Simone
*Attorney, Agent, or Firm*—Cyrus S. Hapgood

[57] ABSTRACT

In a centrifugal separator for separating mixtures into at least two fractions, especially one liquid fraction and one solid phase fraction, where there are permanently open outlets from the rotor for the fractions, there is a need for an automatic control of the flow of at least one of the fractions, especially the solid phase fraction. The invention provides in the outlet a vortex fluidic device which is of a type that does not separate the incoming mixture but which controls the flow by increasing same when the viscosity of the flow increases and vice versa. Thus, there is provided an automatic flow control; and there is a restriction of the flow without reduction of the flow area, which is important for the discharge of the solid phase fraction flow in this type of centrifugal separator.

14 Claims, 11 Drawing Figures

CENTRIFUGE

This invention relates to a centrifugal separator for the separation of an incoming mixture of components and having a rotor with outlets for at least two separated fractions. More particularly, the invention relates to a centrifugal separator for the separation of mixtures of a liquid and a solid substance into at least one liquid fraction and one fraction enriched in solids (i.e., solid phase fraction).

There are many embodiments of such centrifugal separators. The main types have a rotor with a vertical rotation axis, usually provided with a number of conical separation plates, or a rotor with a horizontal rotation axis, usually provided with a conveyor screw mounted within the rotor and rotating at a speed different from that of the former, making possible the transportation of a solid phase fraction (collected in the outermost part of the rotor) in the direction of the rotation axis to a solid phase outlet. There are many other special embodiments.

There are serious problems inherent in the optimal separation of a solid phase fraction from a mixture of a liquid and a solid substance, from a design and operation-economical point of view. This operation is quite common in many industrial branches.

The choice of the type of centrifugal separator is determined by a number of different factors, where especially the solid substance content in the liquid is important and, of course, the particle size distribution of the solid substance and its other properties, like the density difference to the liquid and any abrasive properties.

For mixtures of liquid and solid substance which contain a relatively low content of the latter, there is often used a centrifugal separator with a vertical rotation axis and a rotor provided with circumferentially arranged openings which are intermittently opened. Such a centrifugal separator collects a solid phase fraction (usually called sludge) in the radially outermost part, this solid phase fraction being discharged intermittently through said circumferential openings. Such a centrifugal separator has a relatively complicated and expensive design. If the content of solid substance in the liquid is reasonably high, a centrifugal separator with a rotor having a number of circumferential, constantly open nozzles can be considered. These nozzles, the opening diameter of which is usually of the size 1 mm, may be used for yeast suspensions. The drawback with this type of centrifugal separators is that the opening area of the nozzles must be restricted in order that flow of solid phase fraction, such as yeast concentrate, shall not be too large, considering the high pressure normally prevailing at the nozzles (of the magnitude 150–200 bars) which is caused by the high centrifugal force needed for an efficient separation of such yeast from the liquid. This means that there is a risk of clogging. There is thus a need for some type of control of the flow through the outlet from a centrifugal separator for a solid phase fraction, collected in the radially outer part of the rotor.

One solution of this problem is disclosed, for example, in the Swedish Patent Specification No. 227,106, which relates to a centrifugal separator provided with channels connecting the radially outermost part of the rotor with one receiving chamber located in the lower, inner part of the rotor and provided with an outlet (i.e., paring means), the openings of the channels in the receiving chamber being provided with a valve for opening and closing the channels. In operation, the solid phase fraction (the sludge) flows through the channels down to the receiving chamber, from where it is discharged by a paring tube or the like. Such a centrifugal separator may be provided with a control means which levels out variations in the content of solid substance in the incoming mixture in such a way that the content of solid substance in the discharged solid phase fraction remains relatively constant. Such a control means may comprise a sensing means arranged to sense a property like the viscosity of the discharged solid phase flow and to act upon said valve, via a controller, so that it opens and shuts the channel openings to keep the content of solid substance in the solid phase flow relatively constant. Such a control means can often be used with a relatively good result, but it is expensive and is relatively sensitive to disturbances.

A problem of another type, but related to the one just described, is that the rotors of certain centrifugal separators are formed with such a radius and are driven at such a rotational speed that an intermittent flow through the nozzles in the circumference of the rotor attains such a high speed that the solid substance has a strong abrasive action, causing the closing means in the outlets to be impaired or even destroyed. There is a need for some speed limiting means which does not unduly restrict the flow area.

Even in such cases where the centrifugal separator is used for the separation of a mixture of liquid components, and its objective is an enrichment of the components into two outgoing liquid fractions, there is a need for the control of the flow of at least one liquid fraction, in order to achieve the required degree of enrichment of the component in question.

The problems mentioned above have been solved, according to the present invention, in a way which also gives further design opportunities, by providing a means for the automatic flow control in the discharge path of at least one of said fractions, which means comprises at least one vortex fluidic device wherein the inlet of the spin chamber is connected to the separation chamber of the rotor, the spin chamber being designed not to separate the incoming fraction further and being formed (according to techniques known per se related to vortex fluidics devices) so that the flow through the spin chamber increases with increasing viscosity of said fraction and vice versa.

In the important case where the centrifugal separator is arranged to separate an incoming mixture of a liquid and a solid substance into at least one liquid fraction and one fraction enriched in solid substance (i.e., solid phase fraction) which has been collected in the radially outermost part of the separation chamber of the rotor, said means is provided in the discharge path through the outlet of said solid phase fraction.

Vortex fluidic devices were investigated at the end of the 1920's and have attracted more attention from the beginning of the 1960's within a technology known as "fluidics". A comprehensive review of this technology is given by J. M. Kirshner and S. Katz in "Design Theory of Fluidic Components", Academic Press New York 1975. From this publication, it is obvious that fluidics is theoretically rather well understood but that there have been relatively few practical applications, probably due to the tremendously quick development of electronics during the last decades. Within fluidics, terms are used which are well known in electronics. Thus diodes, triodes, etc. are mentioned.

Thus a vortex diode comprises a substantially rotationally symmetric spin chamber provided with a tangential inlet and at least one central outlet provided in one gable. In one common embodiment, the spin chamber is provided with plane gables and just one central circular outlet. Analogous to the well known electronic diodes, the flow resistance is much higher if a flow is permitted to enter the tangential inlet and to exit the central outlet after having been forced to follow a spiral path, than if the flow direction is reversed. It is not, however, possible to close the flow completely.

A vortex triode comprises a substantially rotationally symmetric spin chamber provided with a radial inlet for a main flow and at least one tangential inlet for a control flow, and at least one central outlet provided in one gable. In such a vortex triode, the main flow can be controlled by providing a control flow which must have a higher pressure than the main flow, because otherwise it cannot enter the spin chamber. With increasing control flow pressure the control flow increases, the main flow and also the sum of the main flow and the control flow decreasing, until the main flow is completely blocked at a "cut-off" point. At this point the control flow alone will flow through the vortex triode.

By providing a vortex fluidic device in the flow path of the outlets of the rotor, there has been provided an opportunity for a flow restriction by a means with limited dimensions, without reducing the flow area, which would mean a risk of clogging. As is obvious from the description above, vortex diodes cannot be controlled, but they show one property which permits a certain automatic control of the flow, which depends on a certain property of the vortex fluidic device, namely, that increasing the viscosity of the flow entering the spin chamber to a value high enough to make the flow resistance being to determinant, will give an increasing flow. This means that vortex fluidic devices give a quite simple automatic control of an incoming flow with varying viscosity, which is obvious from the example given below. Vortex triodes, as is obvious from the description above, can be controlled, which may be an advantage. They are, however, more complicated because of an inlet for a control flow.

In those centrifugal separators which are provided with circumferential nozzles in the rotor, a vortex fluidic device is provided as a nozzle in the discharge channel, preferably in such a way that the substantial direction (looking away from the spiral path through the spin chamber) is radial. It should be noted that in ordinary centrifugal separator rotors provided with permanently open circumferential openings, these are directed in the direction opposite to the rotation direction of the rotor. The reason for this is that it is desired to recover energy of motion, i.e. reaction energy, which would otherwise be lost in the discharge of the solid phase fraction. Using vortex fluidic devices means that the discharge flow speed will be relatively low, and there is no need or even possibility for recovering reaction energy.

The circumferential outlets of the rotor can be substantially axially directed, but this does not create any special problem for the introduction of vortex fluidic devices in the flow path.

In centrifugal separators having channels connecting the outermost part of the rotor with a receiving chamber down in the inner part of the rotor, a vortex fluidic device is provided in each such channel, preferably in the inner part, directed towards the rotation axis of the rotor, i.e. the opening.

It has become obvious that the symmetry axis of the spin chamber can be oriented in different ways in relationship to the rotation axis of the rotor. In one suitable embodiment, said symmetry axis is parallel to this rotation axis. The symmetry axis can also be perpendicular to the rotation axis.

In such arrangements, it may be suitable to provide the gable of the spin chamber, which is oriented radially outermost, as a truncated cone, with a central outlet arranged in the apex of the cone. This embodiment has the advantage that the risk of clogging by solid substances in the spin chamber is minimized.

When the spin chamber is provided with two substantially flat gables, a suitable embodiment is such that the axial extension of the spin chamber is less than its diameter. Especially good results are achieved if said axial extension is 10–30% of said diameter.

If vortex triodes are used, the control flow can be applied in different ways. If the outlets are circumferential in the rotor, the control flow is preferably applied through the rotor spindle and further through a channel in the lower part of the rotor. As previously mentioned, the pressure of the control flow must be higher in order that it shall influence (i.e., reduce) the main flow, for example, the solid phase fraction flow. By applying the control flow from within the spindle (i.e., in the vicinity of the rotation axis of the rotor) there is automatically provided a higher pressure in the control flow when this enters the spin chamber (because of the integrated pressure from the spindle, created by the centrifugal force) than in the main flow, the pressure of which is equal to the pressure in the outermost part of the rotor, as this pressure is created by the liquid head at a distance from the rotation axis of the rotor. Variations of the pressure of the control flow for the control of the main flow can be applied by corresponding variation of the pressure of the source of the control flow.

One drawback in using vortex triodes is that the control flow is combined with the main flow.

The invention will now be described more in detail with reference to the accompanying drawings, wherein all figures are somewhat schematic and in which.

Figure 1:
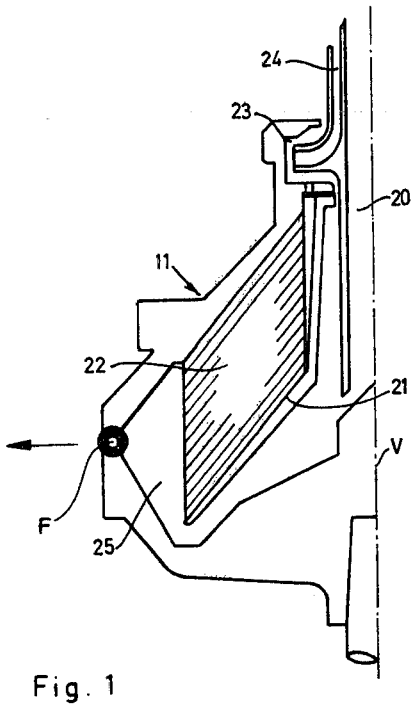
FIG. 1 is a longitudinal sectional view of a centrifugal rotor having radially-extending, circumferential, permanently open outlets, with a vortex fluidic device shown in one of the outlets.

matic flow control through the outlets, meaning that a low dry solids content will give a small flow and a high dry solids content will give a large flow. Such a control will stabilize the separation so that the dry solids content can be kept at a relatively high, even level also when there are variations in the dry solids content of the mixture fed.

To sum up, the following advantages are obtained according to the invention in centrifugal separators of the type herein disclosed:

(1) In rotors provided with permanently open outlets for discharging a solid phase fraction, incoming mixtures with a much lower dry solids content can be separated than has been possible hitherto, without the need of reducing the flow area of the outlet openings, which would mean a risk of clogging.

(2) Roughly estimated, the flow area can be increased twofold by the introduction of a vortex fluidics device, as compared to hitherto known outlet designs, without increasing the flow, which thus means an improved safety against clogging.

(3) An automatic control of the dry solids content in the discharged solid phase fraction flow can be obtained within a relatively broad variation of the dry solids content in the mixture fed. p (4) A higher dry solids content in the discharged flow is possible due to the favorable relationship between flow area and flow.

(5) When separating mixtures of liquids, where a certain enrichment of at least one component is desired, the degree of enrichment can be achieved by automatic flow control due to the viscosity difference between the liquids.

I claim:

1. For separating a mixture of components, a centrifugal separator comprising a rotor forming a separating chamber and having outlets for two separated fractions of the mixture, the rotor forming a discharge flow path through the outlet for one of said fractions, and a vortex fluidic device in said discharge path for automatically controlling the flow therethrough, said vortex device having a spin chamber with an inlet connected to said separating chamber, the spin chamber being incapable of further separation of said one fraction entering said inlet, the vortex device being operable to increase the flow through the spin chamber with increasing viscosity of said one fraction and vice versa.

2. The separator of claim 1, in which said one fraction is a solid phase fraction collected in the radially outermost part of said separating chamber, said vortex fluidic device being located in said discharge path for said solid phase fraction.

3. The separator of claim 1, in which the vortex fluidic device is located in the vicinity of the circumference of the rotor.

4. The separator of claim 1, in which the flow direction of said outlet for said one fraction is substantially radial with respect to the rotation axis of the rotor, said spin chamber being oriented with its symmetry axis substantially perpendicular to a radius of the rotor.

5. The separator of claim 1, in which the flow direction of said outlet for said one fraction is substantially radial with respect to the rotation axis of the rotor, said spin chamber being oriented with its symmetry axis parallel to said rotation axis.

6. The separator of claim 1, in which the flow direction of said outlet for said one fraction is substantially parallel to the rotation axis of the rotor, said spin chamber being oriented with its symmetry axis substantially perpendicular to said rotation axis.

7. The separator of claim 1, in which the rotor also has a receiving chamber for said one fraction, said outlet for said one fraction including a channel connecting the radially outermost part of the separating chamber to said receiving chamber, the vortex fluidic device being located in said channel.

8. The separator of claim 1, in which said vortex fluidic device is a vortex diode having a substantially rotationally symmetric spin chamber provided with a tangential inlet from said separating chamber, said spin chamber having a gable provided with a central outlet from the spin chamber.

9. The separator of claim 1, in which the spin chamber has two substantially planar gables, the axial extension of the spin chamber being less than its diameter.

10. The separator of claim 9, in which the axial extension of the spin chamber is 10–30% of its diamater.

11. The separator of claim 1, in which the vortex fluidic device is located in the vicinity of the circumference of the rotor, said spin chamber having a symmetry axis oriented substantially perpendicular to the rotation axis of the rotor and directed towards said rotation axis, the spin chamber having an outlet directed radially outward from said rotation axis.

12. The separator of claim 11, in which the spin chamber has a gable at the radially outermost part of the spin chamber, said gable being formed at least partly as a cone.

13. The separator of claim 1, in which said vortex fluidic device is a vortex triode having a substantially rotationally symmetric spin chamber, said spin chamber having a radial inlet for a main flow from said separating chamber and also having a tangential inlet for a control flow, the spin chamber also having a gable provided with a central outlet from the spin chamber.

14. The separator of claim 13, in which said outlet from the spin chamber is located in the circumferential part of the rotor, the rotor having a channel for conducting said control flow to said tangential inlet, the rotor also having an axial spindle for conducting said control flow to said channel.

* * * * *

Figure 8:
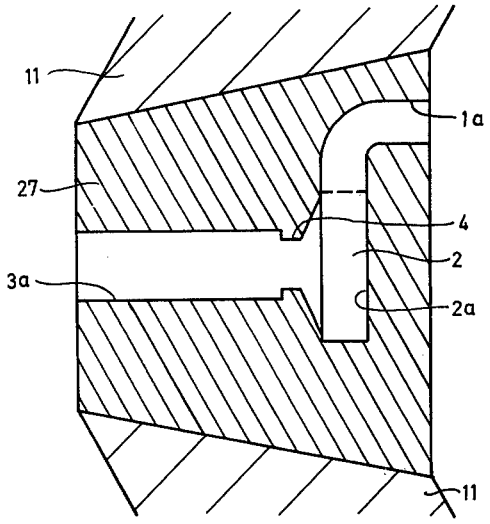
Figure 9:
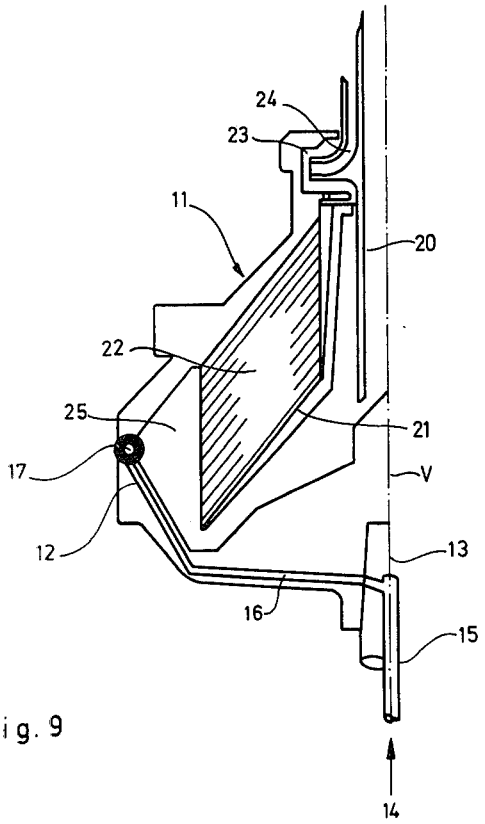
Figure 10:
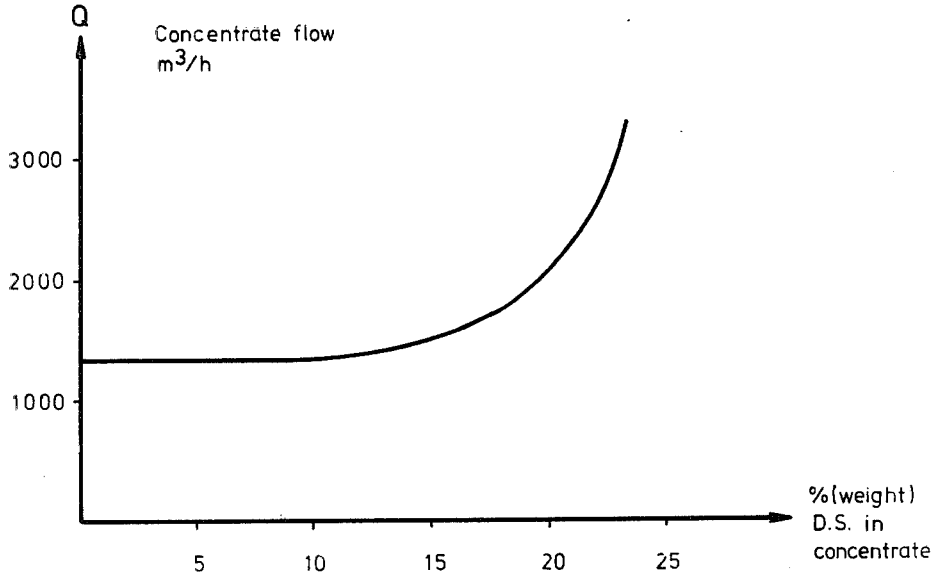
Figure 11:
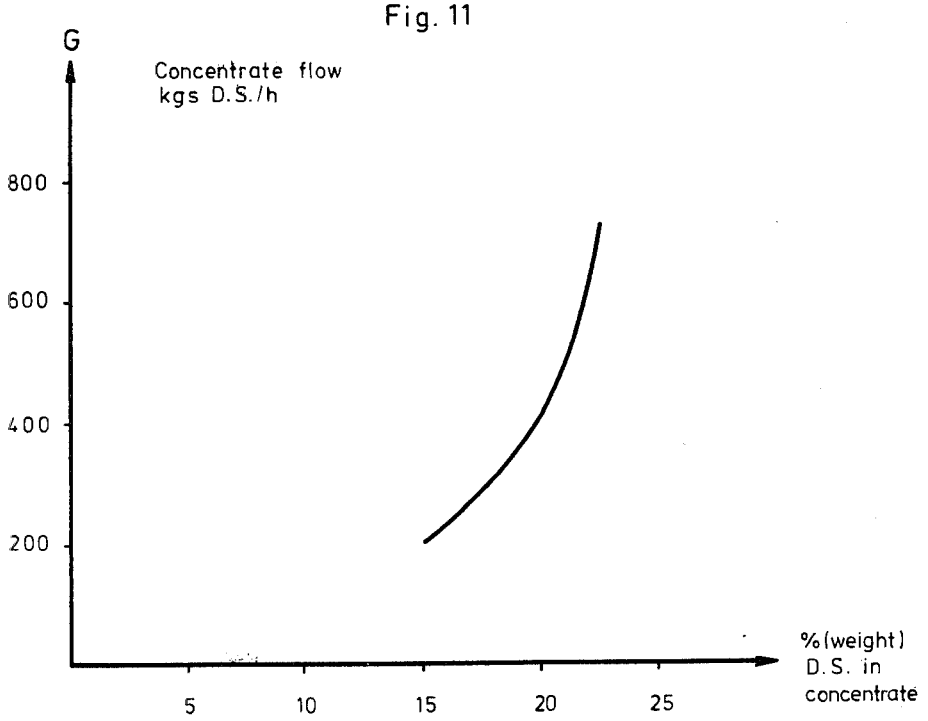

FIG. 8 is a sectional view of an alternative orientation of a vortex fluidic device in a radial outlet, with a conical gable;

FIG. 9 is a longitudinal sectional view of a centrifugal rotor having circumferential, radial outlets, with a vortex triode shown in one of the outlets;

FIG. 10 is a diagram of the concentrate flow as a function of the dry solids content in a test with a centrifugal separator according to the invention, and FIG. 11 is a corresponding diagram, with the solid phase fraction flow as a function of the dry solids content of the concentrate.

The centrifugal rotors in FIGS. 1, 2, 3 and 9 are mounted for rotation about a vertical axis V and may be of conventional form as indicated generally at 11. In each case as shown, a central stationary inlet pipe 20 extends axially downward into a conventional conical distributor 21 of the rotor; and the feed mixture from pipe 20 flows around the outer edge of distributor 21 into a separating chamber containing a set of spaced conical discs 22, as is conventional. A separated lighter component of the feed mixture is displaced radially inward from between the discs 22 and flows upwardly into a paring chamber 23 of the rotor, from which it is discharged by a stationary paring device 24, and at the same time the separated heavy component moves to the outer peripheral part 25 of the separating chamber, as will be readily understood by those skilled in the art.

Figure 2:
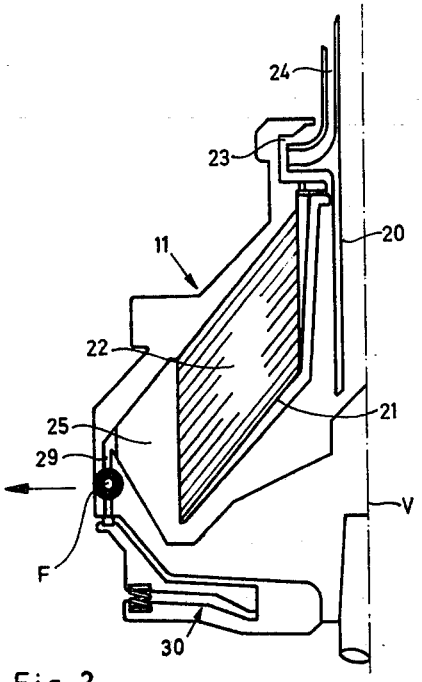
FIG. 2 is a similar view of a centrifugal rotor having axially-extending, intermittently circumferential outlets, with a vortex fluidic device shown in one of the outlets.
Figure 3:
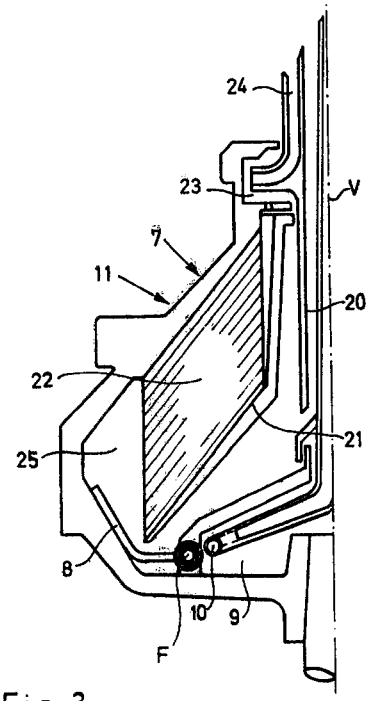
FIG. 3 is a similar view of a centrifugal rotor having a discharge channel directed inwardly and at the inner opening of which a vortex fluidic device is shown.
Figure 5:
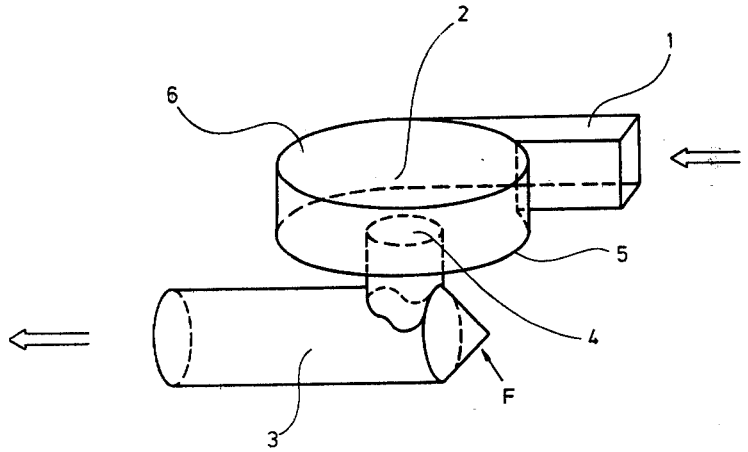
FIG. 5 is a perspective view of a vortex diode.

In each of the rotors in FIGS. 1, 2 and 3, a vortex fluidic device indicated generally at F is located in the outlet or discharge path for the separated heavy component. As shown in FIG. 5, the device F is a vortex diode comprising an inlet channel 1, a spin chamber 2 and an outlet channel 3 connected to a central outlet 4 provided in one gable 5 of the spin chamber 2. The second gable 6 has no central outlet in this case, but there are such designs, as previously mentioned.

Figure 6:
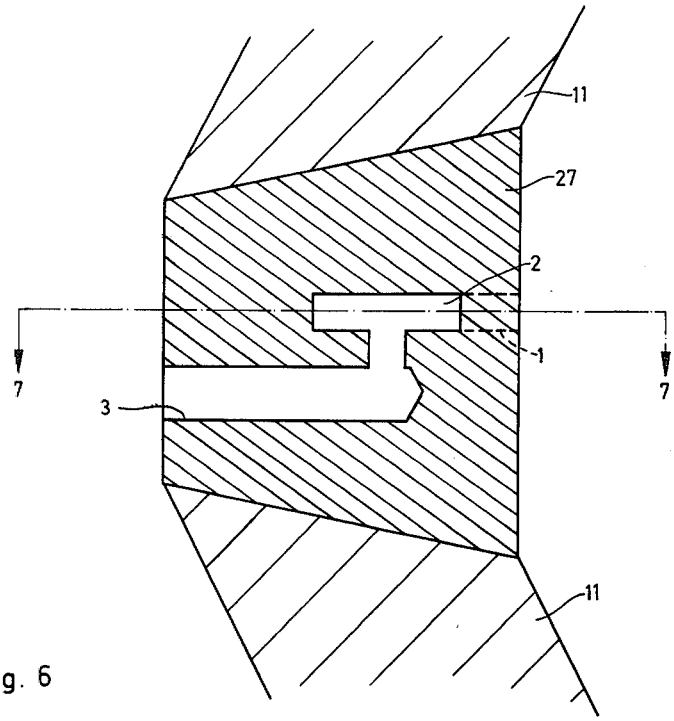
FIG. 6 is an enlarged sectional view of the radial outlet of the centrifugal rotor in FIG. 1.
Figure 7:
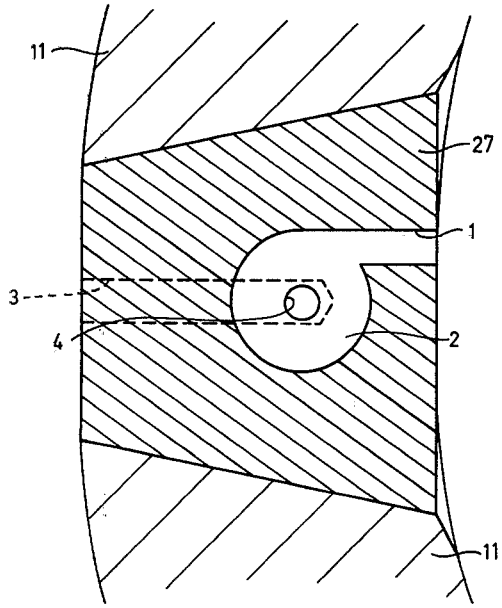
FIG. 7 is a horizontal sectional view on line 7—7 in FIG. 6.

The vortex diode indicated at F in FIG. 1 is disclosed more in detail in FIGS. 6 and 7, where it is shown as being incorporated in discharge nozzle 27. The spin chamber 2 is oriented in such a way in the outlet that the discharge flow path is substantially radially directed. The symmetry axis of the spin chamber is parallel to the rotation axis of the centrifugal rotor.

In FIG. 8 there is shown an alternative orientation and design of a vortex diode, arranged in a substantially radially directed outlet. In this case the symmetry axis of the spin chamber 2*a* is radially directed in the rotor wall, with the central outlet 3*a* directed radially outwards. The gable of the spin chamber provided with the outlet is also formed partly as a cone, which means that the risk of clogging by solid substances entering inlet 1*a* is minimized.

The centrifugal rotor shown in FIG. 2 has peripheral outlets extending parallel to the rotor axis and one of which is shown at 29. Each outlet 29 is intermittently closed by a conventional arrangement indicated generally at 30. In this case the vortex diode F is suitably oriented in such a way that the symmetry axis of the spin chamber 2 is perpendicular to the rotation axis of the rotor. As the discharge flow speed has been restricted without reducing the flow area, the problem of abrasion of the solid particles on the closing means, due to the high discharge flow speed (in turn dependent on the high pressure prevailing in this type of centrifugal separator within the area of entrance of the outlets) is solved.

Figure 4:
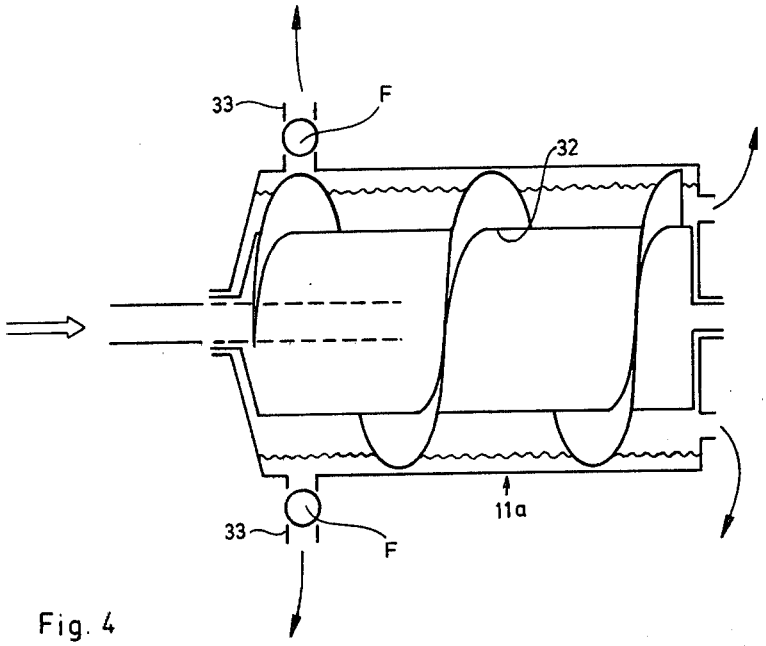
FIG. 4 is a longitudinal sectional view of a centrifugal rotor having a horizontal axis and an inner conveyor screw, with vortex fluidic devices shown in radial outlets in the circumference of the rotor.

The centrifugal rotor 11*a* shown in FIG. 4 rotates about a horizontal axis and contains a conveyor screw 32. The rotor has circumferential, radial outlets 33 provided with a vortex fluidic device F suitably arranged with the symmetry axis of the spin chamber 2 parallel to the rotation axis of the rotor. In centrifugal separators with a horizontal axis and conveyor screw within the rotor, the latter normally comprises a circular cylindrical part and a truncated conical part. The reason for this is that it is desired to transport the separated solid phase fraction (i.e., the sludge) radially inwards so that it can be discharged from the centrifugal separator without contact with the liquid phase. Theoretically, a rotor consisting solely of a cylinder provided with circumferential outlets with a quite limited flow area would be possible, but due to the property of the solid substance in normal applications, such a rotor would not operate in a practical manner due to clogging. An increase of the flow area in ordinary outlets, in order to avoid this drawback, would mean too large a flow, whereby the dry solid content of the discharged fraction would be too low. The use of vortex fluidic devices makes such a design possible thanks to the combination of a large flow area and a low flow.

In the centrifugal separator of FIG. 3, the rotor 11 is provided with channels 8 directed inwards from the outermost part 25 of the rotor to a receiving chamber 9 down in the rotor, and a vortex diode is provided at the inner opening of each channel 8. One solid phase fraction is discharged from the receiving chamber 9 by a paring tube 10. The symmetry axis of each spin chamber 2 is suitably oriented parallel to the rotation axis of the rotor. This design permits the flow through channels 8 to be restricted without any risk of clogging.

In FIGS. 1–4, the rotor outlets for the separated heavy component are provided with vortex diodes. In FIG. 9, the centrifugal rotor 11 has circumferential, radial outlets 12 each provided with a vortex triode 17. A control flow is fed to the hollow spindle 13 from a source 14 and is conducted through channels 15 and 16 to the vortex triode 17. In this case there is a simple possibility to control the solid phase fraction flow through the outlet 12 by varying the pressure of the source 14. Of course, it must be considered that the control flow will be discharged through the outlet 12.

EXPERIMENTAL RESULTS

In one practical operation test, a centrifugal separator rotor was provided with circumferential, radial outlets, as is shown in FIGS. 1, 6 and 7, with vortex diodes. The dimensions of these were: Inlet area, square 1.0×1.0 mms, spin chamber axial extension 1.0 mm, diameter 7.0 mm, central outlet diameter 1.0 mm. The radius of the rotor was 278 mms. The number of the outlets was 12. C:a 4700 r.p.m. were applied. In the test, yeast suspensions with varying dry solids content were centrifuged. From FIG. 10 it can be seen which solid phase fraction flows Q kgs/h of yeast concentrate were obtained at different dry solids contents in same. In FIG. 11 these results have been recalculated to mean G kgs/h dry substance (=yeast d.s.) per hour passing the circumferential outlets at different dry solids contents in the discharged flow.

As is obvious from the curves, the flow through the outlets provided with vortex diodes increases with increasing dry solids contents and thus increasing viscosity. This means that with a varying content of dry solids in the incoming mixture, there will be a certain auto-